US009144729B2

(12) United States Patent
Foster

(10) Patent No.: US 9,144,729 B2
(45) Date of Patent: Sep. 29, 2015

(54) ELECTRONIC DOWN AND DISTANCE MARKER SYSTEM

(71) Applicant: James Michael Foster, Raytown, MO (US)

(72) Inventor: James Michael Foster, Raytown, MO (US)

( * ) Notice: Subject to any disclaimer, the term of this patent is extended or adjusted under 35 U.S.C. 154(b) by 74 days.

(21) Appl. No.: 14/211,906

(22) Filed: Mar. 14, 2014

(65) Prior Publication Data

US 2014/0259708 A1 Sep. 18, 2014

Related U.S. Application Data

(60) Provisional application No. 61/793,119, filed on Mar. 15, 2013.

(51) Int. Cl.
*G01C 15/06* (2006.01)
*A63B 71/06* (2006.01)

(52) U.S. Cl.
CPC ..... *A63B 71/0605* (2013.01); *A63B 71/0619* (2013.01); *A63B 2220/12* (2013.01); *A63B 2220/89* (2013.01); *A63B 2225/50* (2013.01); *A63B 2243/007* (2013.01)

(58) Field of Classification Search
CPC ..... A63B 71/0605; A63B 71/0619; A63B 2220/12; A63B 2220/89; A63B 2225/50; A63B 2243/007
USPC ..... 33/289, 700
See application file for complete search history.

(56) References Cited

U.S. PATENT DOCUMENTS

| | | | | |
|---|---|---|---|---|
| 3,300,861 | A * | 1/1967 | Lilly | 33/289 |
| 4,837,957 | A | 6/1989 | Egender | |
| 6,907,840 | B1 * | 6/2005 | Gaines | 33/289 |
| 7,770,297 | B1 * | 8/2010 | Sommerfeld | 33/289 |
| 2004/0111903 | A1 * | 6/2004 | Amron | 33/289 |
| 2004/0200082 | A1 * | 10/2004 | Dinicola | 33/289 |
| 2005/0143199 | A1 * | 6/2005 | Saroyan | 473/438 |
| 2006/0128503 | A1 * | 6/2006 | Savarese et al. | 473/353 |
| 2008/0184571 | A1 * | 8/2008 | Kivley | 33/289 |
| 2008/0256811 | A1 * | 10/2008 | Garza | 33/289 |
| 2010/0236115 | A1 * | 9/2010 | Gaetano | 40/598 |
| 2013/0120581 | A1 * | 5/2013 | Daniels et al. | 348/157 |
| 2013/0266918 | A1 * | 10/2013 | Tinjust | 434/247 |
| 2015/0065271 | A1 * | 3/2015 | Peterson | 473/406 |

* cited by examiner

*Primary Examiner* — G. Bradley Bennett
(74) *Attorney, Agent, or Firm* — Husch Blackwell LLP

(57) ABSTRACT

An electronic down and distance marker system comprising a first marker; a second marker connected to a first marker by a physical member having a distance of about ten yards; and a down marker. The down and distance marker system may also include a measurement device for measuring a linear distance between the down marker and the second marker; and one or more displays that include a down indicator and a distance indicator. The distance indicator may be electronic communication with the measurement device to display the linear distance between the down marker and the second marker thereon. The electronic down and distance marker system may also be electronic communication with facilities of the stadium including the scoreboards and a display in the press-box.

9 Claims, 2 Drawing Sheets

ELECTRONIC DOWN AND DISTANCE MARKER SYSTEM

CROSS-REFERENCE TO RELATED APPLICATION

This application claims the benefit of U.S. Provisional Patent Application No. 61/793,119, filed Mar. 15, 2013, the entire disclosure of which is hereby incorporated by reference.

FIELD OF THE INVENTION

This present invention relates to a system for measuring, marking, and communicating the down and distance for first downs used in American football. The system of the present invention includes a plurality of markers, a distance measurement component, and an electronic display. The present system may also include additional features for communicating the information throughout the stadium for display to participants, attendees, and coaching staffs.

BACKGROUND OF THE INVENTION

Currently, the down marker used in all levels of American football to convey the down are based upon a DIAL-A-DOWN® or similar systems are in use wherein a mechanical device can set a plurality of moveable panels in a number of settings which provide a configuration of the panels that communicate a number from one (1) to four (4). This current DIAL-A-DOWN and similar systems are used in the National Football League, and has become the standard in the collegiate, high school and younger leagues. These DIAL-A-DOWN type systems convey only the down and the placement of the marker is the only indication of the distance to-go for a first down. Thus, a person must use their own judgment to view the relative positions of the markers and judge the distance to go.

Modern American football offenses have become very complex and often chart plays for particular down and distance. This can be an issue when a spotter is trying, based upon his own vision and relative distance interpretation, provide the remaining yardage to a first down. Moreover, fans and attendees have become much more engaged in the games and, as with other aspects of their life, desire football games to become more interactive and provide more and more information. In these regards, the existing DIAL-A-DOWN type system fails greatly.

As such, there is a need in the art for an American football down and distance marker system that provides real-time and accurate information to the participant athletes, the coaching staffs, and the fans/attendees. There is a further need in the art for an American football down and distance marker system that provides a visual display of the down and a measured distance necessary to obtain a first down.

SUMMARY OF THE INVENTION

An electronic down and distance marker system comprising a first marker, a second marker connected to a first marker by a physical member having a distance of about ten yards, a down marker, a measurement device for measuring a linear distance between said down marker and said second marker; and one or more electronic displays disposed on one of said down marker and said second marker. The one or more displays include a down indicator and a distance indicator, wherein the distance indicator is in wired or wireless communication with the measurement device to display the measured linear distance between the down marker and the second marker.

The electronic down and distance marker system of claim 1 wherein said one or more electronic displays is an E-ink display. The electronic down and distance marker system of claim 1 wherein said measurement device is one of sonic, laser or GPS.

The electronic down and distance marker system may also include a first electronic display that is disposed on the down marker, wherein the first electronic display includes the down indicator. A second electronic display may also be disposed on the second marker, wherein the second electronic display includes the distance indicator. The distance indicator may include a first mode for displaying a distance in yards and a second mode for displaying a distance in feet and/or inches upon the measured linear distance being less than one yard. The distance indicator may also include the first mode and the second mode being displayed in different colors.

The electronic down and distance marker of may also include a syncing device for syncing one or more of a scoreboard, a press box display, or other user display with the down indicator and the distance indicator. The syncing device may be through Bluetooth or other wireless communication, such as Wi-Fi with a 2.4 & 5-6 GHz dual-band RF power amplifier or other known wireless communication technology.

BRIEF DESCRIPTION OF THE SEVERAL VIEWS OF THE DRAWINGS

The accompanying drawings form a part of the specification and are to be read in conjunction therewith, in which like reference numerals are employed to indicate like or similar parts in the various views.

DETAILED DESCRIPTION OF THE INVENTION

The following detailed description of the present invention references the accompanying drawing figures that illustrate specific embodiments in which the invention can be practiced. The embodiments are intended to describe aspects of the present invention in sufficient detail to enable those skilled in the art to practice the invention. Other embodiments can be utilized and changes can be made without departing from the spirit and scope of the present invention. The present invention is defined by the appended claims and, therefore, the description is not to be taken in a limiting sense and shall not limit the scope of equivalents to which such claims are entitled.

Figure 1:
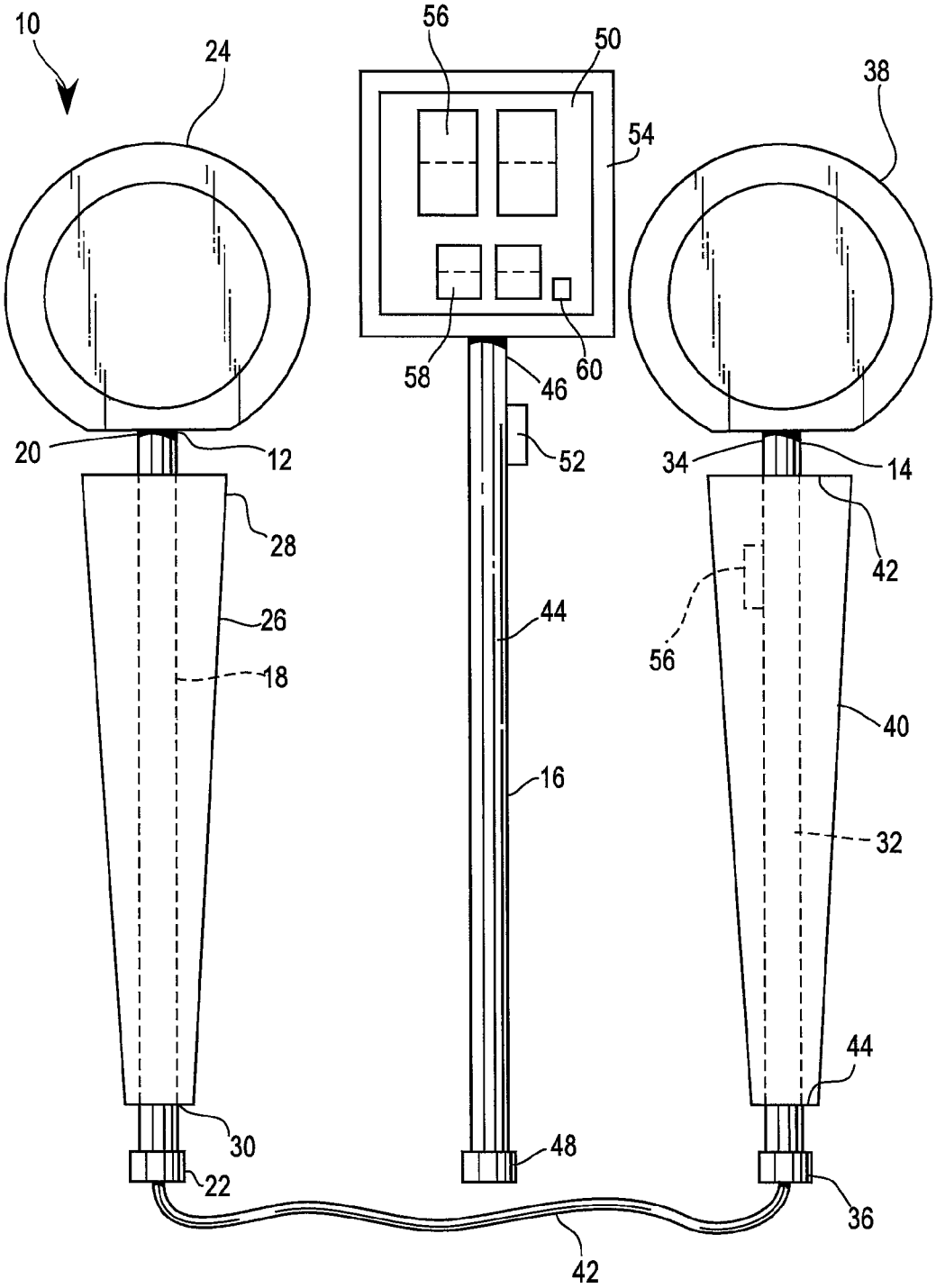
FIG. 1 is a perspective view of one embodiment of a down and distance marker in accordance with the teachings of the present disclosure.

The present invention is directed to a down and distance marker system 10 that improves on existing down and distance marker systems by including a distance measurement system coupled to an electronic display which conveys not only the down, but also the measured distance to obtain a first down. Accordingly, as shown in FIG. 1, the present down and distance marker system 10 includes a first marker 12 for indicating the original line of scrimmage of the first down, a second marker 14 operably connected to said first marker at a fixed distance of ten (10) yards, and a down marker 16 which is independent of first marker 12 and second marker 14 which is used to mark the exact position of the football on the field for any given down.

Figure 2:
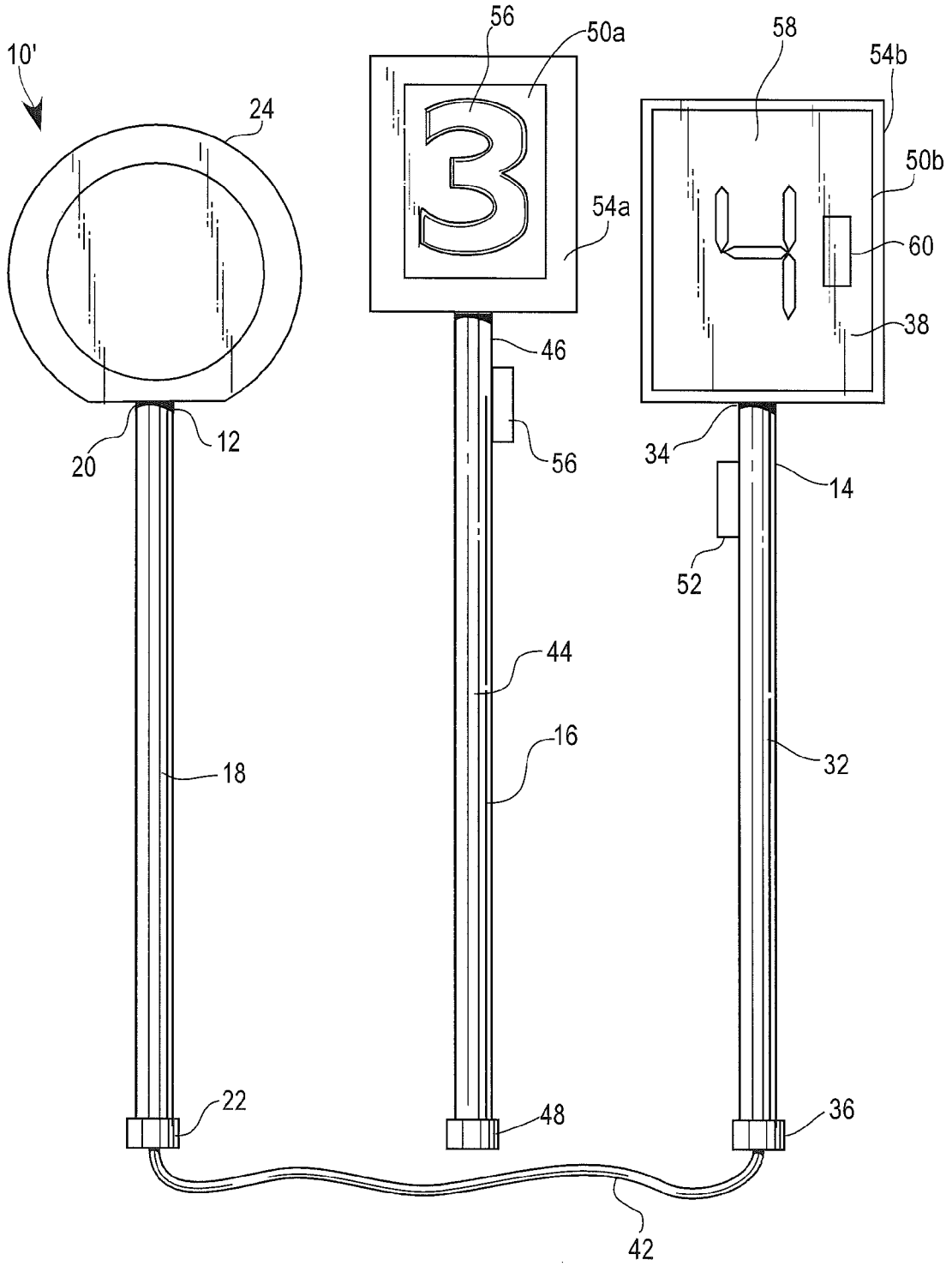
FIG. 2 is a perspective view of another embodiment of a down and distance marker in accordance with the teachings of the present disclosure.

First and second markers 12 and 14 may be of conventional design. First marker 12 may include a longitudinal rod 18 having a first end 20 and second end 22, a target 24 coupled to the first end 20 of the longitudinal rod 18, a flag portion 26 having a first end 28 and a second end 30 wherein each end 28 and 30 is attached along the length of longitudinal rod 18. Similarly, second marker 14 may include a longitudinal rod 32 having a first end 34 and second end 36, a target 38 coupled to the first end 34 of the longitudinal rod 32, a flag portion 40 having a first end 42 and a second end 44 wherein each end 42 and 44 is attached along the length of longitudinal rod 32. In one embodiment, flag portions 26 and 40 are taut. In one embodiment, one or more of the targets 24 or 38 of the first and second markers 12 and 14 may include a digital display 50 similar to those described below and as shown in FIG. 2. Turning back to FIG. 1, the distance between first marker 12 and second marker 14 is such to provide an accurate distance of ten (10) yards. This may be accomplished through a physical member 42 such as a chain, a rope, band, a cable, or other flexible tension member calibrated to provide a measurement of ten (10) yards. Alternatively, an embodiment not shown may include an electronic indicator wherein a GPS, sonic, light, or laser distance measurement system is incorporated into the second marker 14 which will provide an audio or visual indicator that the distance of exactly ten yards between the first and second markers. However, the physical member 42 is preferred at this point for its accuracy, simplicity and ease of repetition.

Down marker 16 may include a rod 44 having a first end 46 and a second end 48, and an electronic visual display 50 coupled to first end 46 of rod 44. Down marker 16 may also include a measurement device 52 that is stand-alone as shown or implemented into a housing 54 for visual display 50. Alternatively, measurement device 52 may be included on second marker 14 as shown on FIG. 2.

Measurement device 52 determines the linear distance between down marker 16 and second marker 14. Measurement device 52 may be a sonic or light-based (laser) distance measurement device and may work in conjunction with a sensor 56 attached to rod 32 of second marker 14 when measurement device 52 is on down marker 16 or sensor 56 may be attached to down marker 16 when measurement device 52 is on second marker 14. However, measurement device 52 may not require sensor 56 and a measurement may be taken by measuring the distance between the rod 32 of the second marker and rod 44 of down marker 16. Measurement device 52 may also use GPS triangulation as known in the art to use satellites and transponders associated with second marker 14 and down marker 16 to determine and compare the positions thereof to determine the linear distance between down marker and second marker 14. Laser distance measuring technology similar to that used in laser rangefinders for hunting and golf, as well as laser distance measuring technology used in land surveying equipment may be implemented.

Visual display 50 is housed in housing 54. Visual display may display one or more of the down, and the distance required to obtain a first down. The visual display is preferably an E-ink configuration, but may also be LED, Plasma, and fiber-optic or other electronic display technology. Visual display preferably includes the ability to display colors, a bright effect to be seen during daylight hours, viewable from multiple angles, little to no glare, can be manufactured in multiple sizes, and has some resilience and flexibility to withstand impact of players or being dropped for a long useful life. An E-ink display is preferable as it adequately and reliably provides many of the above features. Any colors may be implemented in the display; however, visible colors for the display are bright green, red, orange or other bright color such as neon colors may be preferred. Visual display 50 may be one-sided or two-sided. Thus, in the event the visual display 50 is two-sided, the information may be viewed from both the front and the back.

Preferably, display 50 includes a display for a down indicator 56 and a display for the distance indicator 58. The display for down will display one (1) through four (4) and may be controlled by a sequential switch or each setting having its own button, switch or toggle on the back of housing 54. The display for distance indicator 58 may be automatically populated and connected to measurement device 52. Further, housing 54 of the display 50 may also include a display on the back for the user to view the contents of the bigger public facing display. This second display may allow the user to preview the distance prior to the distance to second marker 14 being populated on display 50. The distance indicator 58 will show the distance in yards, which may be rounded to the closest yard when the distance is greater than one yard. Another embodiment may provide a "tenths" area 60 which is smaller, but provides a tenth-of-yard measurement along with the yards. Another embodiment of the present system 10 provides the distance in feet and inches when the distance measured is under a yard. The system may also include a color change when displaying in feet and inches versus the typical yard measurements. The housing 54 and display 50 are preferably waterproof and durable enough to withstand a hit in a football game. The display 50 must also have large enough numbers to be seen from the stands of a stadium. Moreover, the position and size of the down indicator 56 and the distance indicator 58 may be exchanged in one display, each being on a separate display, or otherwise placed on one or more display 50 to convey the above information.

Housing 54 will also include a microprocessor and electronic circuitry necessary to control the operation of the display 50 and measurement device 52. Housing 54 will also include a mobile power source such as a battery supply. The battery may be one-use or rechargeable with a rechargeable battery being preferred and a battery life that will last the duration of a football game. Battery may be alkaline, lithium, NiCad, or any other battery now known or hereafter developed which is capable of being utilized in the present system 10. A preferable embodiment utilizes a LiFePO4 battery (lithium iron phosphate) as these batteries have a long useful life, are safe to use, have a high energy density and can be recharged.

In an alternative embodiment shown in FIG. 2, down and distance marker system 10' includes a display **50*a* on down marker 16 which is the down indicator 56 and a second display 50*b* on second marker 14 which is the distance indicator 58. Each display 50*a* and 50*b* have the functionalities described above and may include a housing 54*a* and 54*b* to control and power each display. Moreover, down and distance marker system 10' is shown without flag portions 26 and 40 (see FIG. 1**) as these elements are not required to effectuate the present down and distance marker system.

The present down and distance marker system 10 and 10' may also incorporate Bluetooth, a Wi-Fi connection (such as provided by a 2.4 & 5-6 GHz dual-band RF power amplifier), or other known wireless technology to communicate the measured information to an announcer, directly to score boards, or other stadium displays. This Bluetooth or other known wireless technology may comprise a syncing device that syncs the scoreboard, a press box display, and/or other display for any user, including spectator's mobile devices with the down indicator and the distance indicator.

In use, a field team of three persons would operate system 10 of the present invention. Upon the first possession of the football game and each subsequent first down, a first person would position the first marker on the sideline corresponding to the initial line of scrimmage. The second person would then position the second marker 14 on the same sideline a distance of ten (10) yards in the direction the offensive team is traveling in an attempt to score. A third person would place down marker 16 on the sideline adjacent to first marker 12 for the impending first down. Display 50 would then display first down and 10 yards to go. The first and second markers 12 and 14 remain in position until the offensive team scores a first down or the possession of the ball changes. Upon the performance of an offensive play, the third person will position down marker 16 according to the resulting line of scrimmage. If the offensive team moves toward the goal, the down marker 16 moves closer to second marker 14. If the offensive team moves away from the goal, the down marker 16 moves away from second marker 14.

The measurement device 52 is activated or automatically determines the linear distance along the sideline between second marker 14 and down marker 16. The third person then designates the next down on the display 50 or 50*a* and down indicator 56 and populates the measured difference manually or automatically on display 50 or 50*b* which includes the distance indicator 58. This sequence will occur after every play of the game except kickoffs. The down indicator 56 and/or the distance indicator 58 may be electronically coupled through a wired or wireless network to a scoreboard or display in the press-box in the stadium, and/or to a spectator's smart-phone or other portable device. This electronic communication may be called a syncing device. Moreover, the syncing device or electronic communication may cause the scoreboard or other displays to automatically populate the down and distance displayed by the present down and distance marker on the field on each device.

As is evident from the foregoing description, certain aspects of the present invention are not limited to the particular details of the examples illustrated herein. It is therefore contemplated that other modifications and applications using other similar or related features or techniques will occur to those skilled in the art. It is accordingly intended that all such modifications, variations, and other uses and applications which do not depart from the spirit and scope of the present invention are deemed to be covered by the present invention.

Other aspects, objects, and advantages of the present invention can be obtained from a study of the drawings, the disclosures, and the appended claims.

I claim:

1. An electronic down and distance marker system comprising:

a first marker;

a second marker connected to a first marker by a physical member having a distance of about ten yards;

a down marker;

a measurement device for measuring a linear distance between said down marker and said second marker; and one or more electronic displays disposed on one of said down marker and said second marker, said one or more displays including a down indicator and a distance indicator, said distance indicator in communication with said measurement device to display said linear distance between said down marker and said second marker.

2. The electronic down and distance marker system of claim 1 wherein said one or more electronic displays is an E-ink display.

3. The electronic down and distance marker system of claim 1 wherein said measurement device is one of sonic, laser or GPS.

4. The electronic down and distance marker system of claim 1 wherein a first electronic display is disposed on said down marker, said first electronic display including the down indicator and a second electronic display is disposed on said second marker, said second electronic display comprising the distance indicator.

5. The electronic down and distance marker of claim 4 wherein said distance indicator includes a first mode for displaying a distance in yards and a second mode for displaying a distance in feet and inches upon said linear distance being less than one yard.

6. The electronic down and distance marker of claim 5 wherein said first mode and said second mode are displayed in different colors.

7. The electronic down and distance marker of claim 1 wherein said distance indicator includes a first mode for displaying a distance in yards and a second mode for displaying a distance in feet and inches upon said linear distance being less than one yard.

8. The electronic down and distance marker of claim 7 wherein said first mode and said second mode are displayed in different colors.

9. The electronic down and distance marker of claim 1 further comprising a syncing device for syncing one or more of a scoreboard or a press box display with the down indicator and the distance indicator.

* * * * *